US006485665B1

(12) United States Patent
Hermanutz et al.

(10) Patent No.: US 6,485,665 B1
(45) Date of Patent: Nov. 26, 2002

(54) METHOD FOR PRODUCING POLYURETHANE ELASTOMER FIBERS AND FIBERS PRODUCED ACCORDING TO THIS METHOD

(75) Inventors: Frank Hermanutz, Leonberg (DE); Peter Hirt, Schorndorf (DE); Oliver Oess, Vernier (CH); Wilhelm Oppermann, Herrenberg (DE)

(73) Assignee: Rhodianyl S.N.C., Courbevoie (FR)

( * ) Notice: Subject to any disclaimer, the term of this patent is extended or adjusted under 35 U.S.C. 154(b) by 0 days.

(21) Appl. No.: 09/555,829

(22) PCT Filed: Nov. 11, 1998

(86) PCT No.: PCT/EP98/07195

§ 371 (c)(1),
(2), (4) Date: Jul. 19, 2000

(87) PCT Pub. No.: WO99/29939

PCT Pub. Date: Jun. 17, 1999

(30) Foreign Application Priority Data

Dec. 10, 1997 (DE) ..... 197 54 886

(51) Int. Cl.[7] ..... B29C 35/10; C08G 18/30; D01D 5/084; D01F 6/70; D06M 10/00

(52) U.S. Cl. ..... 264/470; 264/211.17; 264/234; 264/473; 264/477; 528/48; 528/74; 528/83; 528/906

(58) Field of Search ..... 264/211.17, 234, 264/470, 473, 477; 428/364; 528/48, 74, 83, 906

(56) References Cited

U.S. PATENT DOCUMENTS 3,174,949 A 3/1965 Harper
4,584,325 A * 4/1986 Smith ..... 521/99
5,128,434 A * 7/1992 Lai ..... 526/65
5,310,852 A * 5/1994 Hirai et al. ..... 528/83
5,565,270 A * 10/1996 Rehbold et al. ..... 428/364

FOREIGN PATENT DOCUMENTS

| | | |
|---|---|---|
| DE | 831 772 C | 2/1952 |
| DE | 11 89 268 B | 3/1965 |
| DE | 195 37 608 A1 | 4/1997 |
| EP | 0 548 364 A1 | 6/1993 |

OTHER PUBLICATIONS

Abstract of JP–43007246–B (undated).*
Abstract of JP–57112409–A (Jul. 13, 1982).*
Hermanutz F., et al., *Strahlenvernetzbare Elastanfasern,* Chemiefasern Textil–Industrie, vol. 44, No. 6, Jun. 1, 1994, pp. 388–391.

* cited by examiner

*Primary Examiner*—Leo B. Tentoni
(74) *Attorney, Agent, or Firm*—Darby & Darby

(57) ABSTRACT

Polyurethane elastomer fibers with superior mechanical and heat distortion properties are obtained by a method in which (a) a segmented polyurethane polymer is produced on the basis of a macro-diol, an aliphatic diisocyanate, and a chain extender with at least two hydroxy and/or amino groups, where the polymer has a molar excess of isocyanate groups over the hydroxy and/or amino groups from the macro-diol and chain extender;

(b) the polyurethane polymer is melt-extruded to form a fiber; and (c) The extruded fiber is subjected to a post-treatment.

Steps (a) and (b) are carried out under temperature conditions and within a time interval where essentially no allophanate will be formed, while step (c) is performed under temperature conditions and within a time interval in which the polyurethane polymer is cross-linked through the formation of allophanate.

20 Claims, No Drawings

METHOD FOR PRODUCING POLYURETHANE ELASTOMER FIBERS AND FIBERS PRODUCED ACCORDING TO THIS METHOD

BACKGROUND OF THE INVENTION

The invention relates to a method for producing polyurethane elastomer fibers, and it also relates to the fibers that are produced in accordance with the inventive method.

Polyurethane elastomers are block polymers with a regular structure of soft and hard segments. The soft segments consist of long, flexible chains lacking any order of arrangement, which give the required rubber-like elasticity to the fiber. The properties of the fiber in regard to stretching and tensile strength can be varied depending on the molar mass and the kind of soft segment. The hard segments serve to fixate the soft segments. After a deformation, the return of the molecular chains of the soft segments to their former length occurs in an entropy-elastic manner. The hard segments consist of partially crystalline domains with a structure of short chains. The main task of the hard segments is to serve as anchor points to prevent a slippage of the polymer chains under the influence of mechanical forces. Following an elongation, the shape-restoring forces present in the elastomer will cause a contraction to nearly the original length. The remaining difference in length is called permanent elongation.

In general, polyurethane elastomers are produced in a single step or in a two-step process. In the first step of the two-step process, pre-polymers are formed in a reaction between diols of a higher molecular order and diisocyanates. In a second step, high-molecular end products are formed as the pre-polymers react with so-called chain extenders. Excess quantities of diisocyanate are used in the reaction of the first step, so that the pre-polymer molecule is terminated by isocyanate groups at both ends. The chain extenders are bi-functional, low-molecular compounds terminated by hydrogen atoms, mostly dihydroxy and diamino compounds capable of entering into reactions. The dihydroxy and diamino compounds react with the pre-polymers in the formation of the corresponding carbamic acid derivatives, i.e., the polyurethane elastomers, specifically poly-urea urethane elastomers. In the macro-molecular chains, the soft segments of higher-molecular diols alternate with the rigid hard segments resulting from the reaction of the chain extenders terminated by iso-cyanate groups. The single-step process (also called one-shot process) bypasses the pre-polymer stage, as the diisocyanate reacts simultaneously with the macro-diol and the chain extender.

The difference in the chemical composition of hard and soft segments as well as the difference in their polarities and molecular weights will cause the hard and soft segments to segregate from each other. The formation of hydrogen bridges between neighboring chains has the effect that the hard segments congregate in parallel alignment with each other. The long movable molecule chains in between develop cross-linked interconnections that are loosened and stretched when the loose-knit network is subjected to a tensile deformation. The interaction between the hard segments prevents plastic flow of the molecular chains in the distended state. The stretching of the macro-molecules is associated with a transition into a more highly ordered state and a decrease in entropy. When the mechanical stress load is removed, the thermal motion of the molecules will cause them to return to the cross-linked state that corresponds to a higher level of entropy. Strong mechanical stress loads, however, will break the interaction between the hard segments, causing irreversible structural rearrangements of the hard segments. This has a negative effect on the mechanical hysteresis properties. Especially melt-extruded polyurethane fibers exhibit a large hysteresis loss of elastic energy and force as well as a high amount of permanent elongation. In order to improve the properties of the fibers, it will therefore be necessary to provide a better fixation of the hard segments.

The known methods of producing melt-extruded polyurethane elastomer fibers primarily use a polyurethane polymer based on aromatic diisocyanates, mostly di-phenyl methane-4,4'-diisocyanate (MDI). The polymer coming out of the reaction is melted and processed into a fiber by way of a melt-extrusion process. However, polyurethane polymers based on aromatic diisocyanates are becoming less acceptable, because their decomposition releases aromatic amino groups that are suspected of being carcinogens. In addition, polyurethane polymers based on aromatic diisocyanates have a tendency of yellowing.

OBJECT OF THE INVENTION

It is therefore the object of the present invention to provide a method of producing polyurethane elastomer fibers based on non-aromatic diisocyanates with improved properties, particularly with respect to tear strength, tear elongation, permanent elongation and heat distortion temperature (HDT).

SUMMARY OF THE INVENTION

In accordance with the present invention, the objective is met by a method that has the following steps:

(a) A segmented polyurethane polymer is produced on the basis of i) a macrodiol with a molecular weight of approximately 500 to 10,000, ii) an aliphatic, cycloaliphatic and/or aliphatic-cycloaliphatic diisocyanate and iii) a chain extender with at least two hydroxy and/or amino groups. As a percentage of the sum of the hydroxy and amino groups, the polymer has a molar excess of isocyanate groups of at least approximately 0.2% over the hydroxy and/or amino groups from the macrodiol and chain extender.

(b) The polyurethane polymer is melt-extruded to form a fiber. Steps (a) and (b) are carried out under temperature conditions and within a time interval where essentially no allophanate will be formed.

(c) The fiber is subjected to a post-treatment under temperature conditions and within a time interval in which the polyurethane polymer is cross-linked through the formation of allophanate.

The polyurethane polymer must melt and be in the liquid phase at a suitable temperature. The polyurethane polymer is produced under the pre-polymer or the one-shot method, either through a reaction between macro-diol, chain extender and diisocyanate with the optional addition of a catalyst, essentially without a solvent, or by melting a preliminary form of polyurethane polymer containing isocyanate groups in stoichiometric proportion or in deficit proportion to hydroxy- and amino groups and by allowing the melted material, possibly after it has cooled down, to react with a diisocyanate and/or an isocyanate-terminated pre-polymer, again essentially in the absence of a solvent.

In preferred embodiments, the polyurethane polymer has a molar excess of iso-cyanate groups in relation to hydroxy- and amino groups of about 0.2% to 15%, the range from 1% to 10% being especially preferred. Polyurethane-polymer chains can be cross-linked through the formation of allophanate- or biuret bonds (Subsequently, only the term "allophanate" will be used. Depending on the context, this is meant to include "biuret"). In this case, an excess isocyanate group reacts with an already formed urethane or urea group, causing a branch in the molecular structure. The applicant has made the observation that allophanate-cross-linked polyurethane polymers based on aliphatic diisocyanates are unsatisfactory for the melt-extrusion process. The extrusion temperatures required for allophanate-cross-linked polyurethanes are in the area of 230° C. The extruded fibers have a high degree of stickiness and inadequate strength. At the high extrusion temperature required, there is furthermore a strong decay in the molar mass of the polymer. The inventive method makes use of the difference in the reaction kinetics between the polyurethane chain formation and the allophanate formation. The formation of the allophanate links occurs more slowly than the build-up of the linear polyurethane chains. Consequently, the polyurethane polymer is produced with a defined excess proportion of isocyanate and is extruded even before the formation of allophanate cross-links sets in. The not yet cross-linked polyurethane can be extruded at relatively low temperatures, so that a thermal decomposition of the polymer is avoided and the tendency of the fibers towards stickiness is reduced. The further treatment of the fibers (winding on spools, tempering, etc.) presents no problems. A subsequent formation of covalent cross-links in the hard segments takes place in the post-treatment of the fibers. In addition to the physical cross-linking by way of hydrogen bridges, a chemical network of allophanate bonds is built up. In comparison to conventionally produced melt-extruded Elastane™ fibers, the inventive method brings a clear improvement of the fiber properties. As an essential advantage, the aliphatic allophanate bonds that are present in the fibers produced according to the invention have significantly better thermal stability than aromatic allophanate bonds.

A person skilled in the art will be able to find, through simple experimentation, suitable temperatures and time intervals for producing and melt-extruding the polyurethane polymer without a significant amount of allophanate being formed in the process. The formation of allophanate becomes noticeable by the fact that the polymer is no longer completely soluble in customary polyurethane solvents such as, e.g., dimethyl formamide (DMF) or dimethyl acetamide (DMA). The following information will serve as a general frame of reference: The polymer can be kept for about two hours at a temperature of 150° C. without an appreciable amount of allophanate formation taking place. If the temperature is lowered by 10° C., the time frame is extended by a factor of 1.2, so that at a temperature of 80° C., about 7 hours will be available. The following formula represents an approximation of the relationship between the length of time and the temperature.

$$t_1 \leqq 2h \times 1.2 \exp[(425K - T_1)/(10K)]$$

It is practical to perform the extrusion on conventional equipment with fiber strengths of 5 to 2000 dtex. The preferred temperature for the melt extrusion is about 80° C. to 180° C., with particular preference for the range from 100° C. to 150° C.

The post-treatment can be a heat-curing process of several hours at a preferred temperature range of 60° C. to 100° C. or, alternatively, room-temperature curing for several days. A post-treatment at temperatures higher than 150° C. is not recommended. The extruded fibers can be laid out on a conveyor belt and sent through a conveyor oven. They can also be wound on spools or bobbins and placed in an oven or environmental chamber. The following formula will serve as a reference for determining the required length of time as a function of the post-treatment temperature:

$$t_2 \leqq 5h \times 1.2 \exp[(425K - T_2)/(10K)]$$

With respect to the macro-diols, the preference is for essentially linear diols which, except for the hydroxyl groups at the ends, carry no other groups that react with isocyanates. The macro-diols have a molecular weight of about 500 to 10,000, preferably 700 to 5000, with special preference for the range from 1000 to 3000. The molecular weight is meant as a weight-averaged mean molecular weight. If the macro-diol rest molecules become too short, the difference in cohesion energy between hard and soft segments becomes greater, causing a greater amount of mixing between the phases and thus inferior elastic properties. Macro-diols with a low glass transition point are preferred. In general, the macro-diols used have glass transition temperatures of about −35° C. to −60° C.

The preference is for using polyester- or polyether glycols. The term polyether glycols means hydroxyl-group terminated polyethers. Polyalkylene glycols are preferred, as for example polyethylene glycol, polypropylene glycol and/or poly-tetra-methylene glycol, with special preference for the last among the foregoing examples. Poly-tetra-methylene glycol, also known as poly-tetra-hydrofuran, can be produced by ionic polymerization of tetra-hydrofuran with acid catalysts. Suitable copolymers are also obtained by polymerizing tetra-hydrofuran with a mixture of propylene oxide, ethylene oxide and glycols. Elastomers that are synthesized from polyether glycols are distinguished by advantageous properties at low temperatures and a high degree of hydrolytic stability.

Suitable polyester glycols are produced preferably through an ester-forming reaction of an aliphatic and/or cyclo-aliphatic dicarbonic acid with excess quantities of a diol.

Among the preferred kinds of dicarbonic acids are succinic acid, glutaric acid, adipic acid, pimelic acid, azelaic acid and sebacic acid. The dicarbonic acid is converted into an ester with an excess quantity of diol, preferably ethylene glycol, diethylene glycol, triethylene glycol, propylene glycol, 1,4-butane diol, 1,5-pentane diol and/or 1,6-hexane diol. Particularly preferred is a polyester of adipic acid and ethylene glycol. Polyester segments have a tendency to crystallize at low temperatures, at the expense of the elastic properties. The crystallizing tendency of polyester chains can be reduced preferably by the incorporation of methyl branches.

This can be accomplished by a partial replacement of the aforementioned diols by other diols such as 1,2-propane diol and 2,3-butane diol, or by using methyl-substituted dicarbonic acids. By using the aforementioned longer-chained glycols, such as 1,4-butane diol, 1,5-pentane diol and/or 1,6-hexane diol, elastomers of increased hydrolytic stability are obtained.

Suitable polyester glycols can also be obtained by a reaction of omega-hydroxy carbonic acids with small amounts of diols or by a ring-opening polymerization of lactones with small quantities of diol. It is also possible to use mixtures of polyether glycols and polyester glycols. As a reference for suitable macro-diols, see also Ullmann's Encyclopedia of Technical Chemistry, 3d edition 1963, published by Urban & Schwarzenberg, Munich and Berlin, vol. 14, pp. 344 f.

The aliphatic, cycloaliphatic and/or aliphatic-cycloaliphatic diisocyanate preferably includes (beyond the isocyanate groups) an alkylene group with 2 to 14 carbon atoms, a cyclo-alkylene group with 5 to 8 carbon atoms and/or an aliphatic-cycloaliphatic group with 7 to 24 carbon atoms. Particularly preferred are hexamethylene diisocyanate and/or dicyclohexyl methane-4,4'-diisocyanate.

The chain extender is a compound containing at least two hydroxy- and/or primary amino groups, preferably a diol or a diamine, which have a low molecular weight in comparison to the macro-diol. In particular, the compounds used for chain extenders are diols, diamines or amino alcohols with 2 to 6 carbon atoms. Preferred are, e.g., ethylene glycol, 1,4-butane diol, cis-2-butene-1,4-diol and 2-butyne-1,4-diol.

Olefin-unsaturated chain extenders are used in one embodiment. The term "olefin-unsaturated" is meant to indicate that the chain extender has one or several double or triple bonds capable of a polymerization reaction. The olefin-unsaturated chain extender can be a diamino alkene, diamino-alkine, diamino cycloalkene, alkene diol, alkine diol and/or cycloalkene diol. Examples of suitable diamines are cis- or trans-1,4-diamino-but-2-ene, cis- or trans-4,4'-diamino stilbene, diamino maleic acid dinitrile, 1,4-diamino but-2-yne and/or 3,6-diamino cyclohexene-(1). Preferred examples of suitable diols are glycerin-l-allyl ether, cis- or trans-2-butene-1,4-diol, 2-butyne-1,4-diol and 5,6-bis-(hydroxy methyl)-bicyclo[2.2.1.]heptene-2. The use of olefin-unsaturated chain extenders permits a further improvement of the mechanical textile properties of the fibers made of the polyurethane elastomers according to the invention in that it induces the covalent cross-linking of the double and triple bonds that are built into the polymer chains. This is accomplished by exposing the extruded fibers to high-energy radiation. Preferably, the fibers are treated with electron beams or UV radiation.

Polyurethane elastomers according to the invention can contain additives such as matte-finish agents, pigments, antioxidants, thermal stabilizers, photo- and specifically UV stabilizers and/or hydrolysis stabilizers.

The polyurethane polymer with free isocyanate groups does not have a stable shelf life because of the allophanate cross-linking that would occur during the storage. It is therefore produced immediately prior to the extrusion process. Under the first of two available methods, the polymer is produced directly from the components according to either the single-step process or the pre-polymer process. The macro-diol, the chain extender and the diisocyanate are brought together in the required quantities at about 60 to 180° C., preferably between 80 and 150° C. for the melt reaction. Optionally, a poly-addition catalyst may be added, preferably dibutyl tin dilaurate or dibutyl tin diacetate, to set a desired reaction level. When using the pre-polymer method, macro-diol and diisocyanate are first combined into the pre-polymer, which is subsequently extended by the chain extender to form the desired polyurethane polymer. The resulting polymer material is immediately extruded into fibers.

Alternatively, i.e., under the second of the two methods, a stable preliminary form of polyurethane polymer is produced in a first phase, containing isocyanate groups in stoichiometric proportion or in deficit proportion to hydroxy-and amino groups. The material can be made into a granulate and put into intermediate storage if necessary. To arrive at the final form of polyurethane to be extruded into fibers, the preliminary product is melted, if necessary. At a preferred temperature of about 100 to 160° C., an aliphatic, cycloaliphatic and/or aliphatic-cycloaliphatic diisocyanate and/or an isocyanate-terminated pre-polymer is added, and the mixture is homogenized. Possibly, the preliminary polymer product could be melted at a higher temperature than the preferred reaction temperature for the mixture, in which case it is good practice to let the melted preliminary product cool down to the appropriate level before adding the diisocyanate and/or isocyanate-terminated pre-polymer. Particularly suitable as isocyanate-terminated pre-polymers are reaction products of macro-diol with 1.1 to 3 molar equivalents of diisocyanate. The preliminary polymer product can be melted in an extruder, in which case the diisocyanate and/or isocyanate-terminated pre-polymer is added preferably either close to the extruder orifice or after the extruder in the melt-material conduit. It is recommended practice to homogenize the mixture, e.g., with static mixers in the melt-material conduit prior to the extrusion of the fibers.

The preferred molar ratio between macro-diol and chain extender in polyurethane polymer is between about 1:4 and 1:1.

The melt-extruded polyurethane fibers made according to the inventive method have clearly superior properties in comparison to conventional melt-extruded polyurethane fibers. The covalent cross-linking of the hard segments through the allophanate bonds significantly improves the hysteresis properties, i.e., the permanent elongation and the loss of elastic tension are significantly reduced while the tear strength and heat distortion temperature are increased.

The invention will be discussed in closer detail based on the following examples.

EXAMPLE 1

A quantity of 100 g (0.05 mol) of polytetrahydrofuran (PTHF, molar weight 2000 g/mol; OH-number 57.3) was measured out into a Teflon™ vessel and heated to 100° C. In 10-minute intervals and with vigorous stirring, 8.99 g (0.102 mol) of butene diol, 28.3 g (0.168 mol) of hexamethylene diisocyanate (HDI), as well as 3 mg of dibutyl tin diacetate as a catalyst, were added. About five minutes after adding the catalyst, the viscosity of the reacting mixture increases strongly because of the build-up in molecular weight. The stirring speed was reduced at this point in order to assure a uniform mixing of the highly viscous polymer melt. To complete the reaction, stirring was continued for another 20 minutes at a temperature of 100° C.

The polyurethane melt, which still contains free isocyanate groups corresponding to the excess of HDI, was used immediately for the melt-extrusion process in a piston extruder. The extrusion temperature was 80° C. and the holding time was 30 minutes. The fiber produced by this process was not sticky and could be wound onto spools without a problem. After a storage interval of two days at room temperature, the fiber was heat-cured for 24 hours at 100° C. The polyurethane elastomer fiber produced in accordance with this example was no longer soluble in dimethylacetamide (DMA) or dimethylformamide (DMF), which indicates the presence of allophanate cross-linking. The fiber had significantly improved properties in comparison to a conventionally melt-extruded fiber (see table).

EXAMPLE 2

Reference for Comparison

The process of example 1 was repeated, but the quantity of HDI was reduced to 25.6 g (0.152 mol), i.e., a stoichiometrically matched quantity with no excess in relation to PTHF and butene diol.

The fibers produced according to examples 1 and 2 were subjected to a test. Measurements of force vs. elongation were made on a Zwick Model 1435 tensile tester. All measurements were made at standard environmental conditions. The measurement methods were based on DIN 53835. The following instrument parameters were selected for the measurement of tear strength and tear elongation: clamping length 50 mm; pre-tensioning force 0 N; elongation rate 500 mm/minute. DIN 53835 part 2 was used for guidance in measuring the permanent elongation. The fibers were stretched and returned to the unstretched condition five times in a constant elongation interval. The instrument recorded the first and fifth of the stretching and unstretching cycles. From the plotted diagram, the permanent elongations and the mechanical parameter $b_{w,5}$ were obtained. The permanent elongation given in the table represents the ratio between the remaining increase in length and the original length of the test specimen. The dimensionless parameter $b_{w,5}$ represents the relative loss in elastic tensioning force from the first to the fifth stretching cycle. The following instrument parameters were used in the measurement of the permanent elongation and the loss of elastic tensioning force: clamping length 100 mm, elongation 300%, pre-tensioning force 0.01 cN/tex, elongation rate 500 mm/minute, number of stretch cycles 5. The heat-distortion temperature (HDT) was measured with a Perkin-Elmer TMA 7 thermo-mechanical analyzer at the following settings: static force 0.002 cN/dtex; rate of temperature increase 2 K/minute. The results are summarized in Table 1.

TABLE 1

| Example | 1 | 2 | 3 |
|---|---|---|---|
| Molar ratio PTHT/butene diol/HDI | 1/2/3.3 | 1/2/3 | 1/2/3.3 |
| $\eta_{rel}$ (0.5 wt. % solution in DMA) | insoluble | 1.34 | insoluble |
| Perm. elongation, 1st cycle [%] | 35 | 95 | 30 |
| Perm. elongation, 5th cycle [%] | 45 | 115 | 41 |
| Tear strength [cN/tex] | 7.0 | 3.4 | 3.5 |
| Tear elongation [%] | 700 | 800 | 600 |
| Loss in tensioning force $b_{w,5}$ | 0.23 | 0.24 | 0.10 |
| HDT [° C.] | 125 | 90 | 175 |

EXAMPLE 3

The process of example 1 was repeated, but prior to extruding, the polymer melt was heat-cured for 20 hours at 80° C., in order to form allophanate cross-linking bonds in the polymer. The extrusion temperature needed for extruding the allophanate-linked polyurethane was 230° C. (holding time about one hour). The extrudability was unsatisfactory. The fibers resulting from the process had a high degree of stickiness and low tear strength. It was impossible to wind the fibers on a spool. Subsequent heat-curing of individual fibers made no significant improvement.

EXAMPLE 4

The fiber produced in the process of Example 1 was irradiated with a Durr electron-beam hardening apparatus with a radiation dose of 200 kGy. The results are given in Table 1 above, demonstrating that a further cross-linking of the hard segments yields an additional degree of improvement.

What is claimed is:

1. A method for producing polyurethane elastomer fibers, comprising the steps of (a) producing a segmented polyurethane polymer based on i) a macro-diol with a molecular weight of approximately 500 to 10,000, ii) at least one diisocyanate belonging to the class consisting of aliphatic, cyclo-aliphatic and aliphatic-cycloaliphatic diisocyanates, and iii) a chain extender with at least two molecular groups belonging to the class consisting of hydroxy and amino groups, the polymer having a molar excess of isocyanate groups of at least approximately 0.2% over the combined total of hydroxy and amino groups from the macro-diol and chain extender, said percentage of 0.2% being in relation to the combined total of hydroxy and amino groups, wherein macro-diol, chain extender and diisocyanate, with the optional addition of a catalyst, are brought together to react with each other, essentially in the absence of a solvent;

(b) melt-extruding the polyurethane polymer to form a fiber, wherein steps (a) and (b) are carried out under temperature conditions and within a time interval where essentially no allophanate will be formed;

(c) subjecting the fiber to a post-treatment under temperature conditions and within a time interval in which cross-linking of the polyurethane polymer will occur through the formation of allophanate; and (d) exposing the extruded fiber to high-energy radiation to effect an at least partial cross-linking of the polyurethane elastomer.

2. A method for producing polyurethane elastomer fibers, comprising the steps of (a) producing a segmented polyurethane polymer based on i) a macro-diol with a molecular weight of approximately 500 to 10,000, ii) at least one diisocyanate belonging to the class consisting of aliphatic, cyclo-aliphatic and aliphatic-cycloaliphatic diisocyanates, and iii) a chain extender with at least two molecular groups belonging to the class consisting of hydroxy and amino groups, the polymer having a molar excess of isocyanate groups in the order of 0.2% over the combined total of hydroxy and amino groups from the macro-diol and chain extender, said percentage of 0.2% being in relation to the combined total of hydroxy and amino groups, wherein a preliminary form of polyurethane polymer containing iso-cyanate groups in a proportion to hydroxy- and amino groups not exceeding the stoichiometric ratio is brought to a melted condition and, after an optional cooling-down time interval, is brought together into reaction with at least one of the reagents from the class consisting of diisocyanate and isocyanate-terminated pre-polymers, essentially in the absence of a solvent;

(b) melt-extruding the polyurethane polymer to form a fiber, wherein steps (a) and (b) are carried out under temperature conditions and within a time interval where essentially no allophanate will be formed;

(c) subjecting the fiber to a post-treatment under temperature conditions and within a time interval in which cross-linking of the polyurethane polymer will occur through the formation of allophanate; and (d) exposing the extruded fiber to high-energy radiation to effect an at least partial cross-linking of the polyurethane elastomer.

3. The method according to claim 1, wherein the polymer has a molar excess of isocyanate groups essentially in the range from 0.5% to 15% over the combined total of hydroxy and amino groups.

4. The method according to claim 1, wherein the macro-diol has a molecular weight essentially in the range of 1000 to 3000.

5. The method according to claim 1, wherein the macro-diol comprises at least one of the class consisting of polyether glycols and polyester glycols.

6. The method according to claim 5, wherein the polyether glycol is a polyalkylene glycol.

7. The method according to claim 6, wherein the polyalkylene glycol comprises at least one of the class consisting of polyethylene glycols, polypropylene glycols and polytetramethylene glycols.

8. The method according to claim 5, wherein the polyester glycol comprises the polyester of a diol and at least one of the class consisting of aliphatic and cycloaliphatic dicarbonic acids.

9. The method according to claim 8, wherein the dicarbonic acid comprises at least one of the class consisting of succinic acid, glutaric acid, adipic acid, pimelic acid, azelaic acid and sebacic acid.

10. The method according to claim 8, wherein the diol comprises at least one of the class consisting of ethylene glycol, diethylene glycol, triethylene glycol, propylene glycol, 1,4-butane diol, 1,5-pentane diol and 1,6-hexane diol.

11. The method according to claim 1, wherein the diisocyanate comprises at least one of the class consisting of an alkylene group with 2 to 14 carbon atoms, a cyclo-alkylene group with 5 to 8 carbon atoms, and an aliphatic-cycloaliphatic group with 7 to 24 carbon atoms.

12. The method according to claim 11, wherein the diisocyanate comprises at least one of the class consisting of hexamethylene diisocyanate and dicyclohexyl methane-4,4'-diisocyanate.

13. The method according to claim 1, wherein the chain extender comprises at least one of the class consisting of diamines, diols and amino alcohols with two to six carbon atoms.

14. The method according to claim 1, wherein the chain extender is olefin-unsaturated.

15. The method according to claim 14, wherein the chain extender comprises at least one of the class consisting of cis-1,4-diamino-but-2-ene, trans-1,4-diamino-but-2-ene, cis-4,4'-diamino stilbene, trans-4,4'-diamino stilbene, diamino maleic acid dinitrile, 1,4-diamino but-2-yne, 3,6-diamino cyclohexene-(1), cis-1,4-but-2-ene diol, trans-1,4-but-2-ene diol, 1,4-but-2-yne diol, and 5,6-bis-(hydroxy methyl)-bicyclo[2.2.1.]heptene-2.

16. The method according to claim 1, wherein the step of melt-extruding the polyurethane polymer is carried out at a temperature essentially within the range of 80° C. to 180° C.

17. The method according to claim 1, wherein the steps (a) and (b) are carried out at a temperature $T_1$ and within a time interval $t_1$ meeting the condition that $$2h \geq \int_{t=0}^{t=t_1} 1.2 \times \exp[(T_1 - 425\ \mathrm{K})/10\ \mathrm{K}]dt.$$

18. The method according to claim 1, wherein the post-treatment is carried out at a temperature $T_2$ and within a time interval $t_2$ meeting the condition that $$5h \leq \int_{t=0}^{t=t_2} 1.2 \times \exp[(T_2 - 425\ \mathrm{K})/10\ \mathrm{K}]dt.$$

19. The method according to claim 1, wherein the molar ratio between macro-diol and chain extender in the polyurethane polymer is essentially in the range between 1:4 and 1:1.

20. The method according to claim 1, wherein the high-energy radiation is one of the class consisting of electron-beam radiation and UV radiation.

* * * * *